United States Patent [19]

Mueller

[11] Patent Number: 5,052,058

[45] Date of Patent: Oct. 1, 1991

[54] SHORTS OR SKIRTS WITH INNER SLIP

[76] Inventor: Klaus Mueller, Schulweg 73B, 5600 Wuppertal 12, Fed. Rep. of Germany

[21] Appl. No.: 171,085

[22] Filed: Mar. 21, 1988

[30] Foreign Application Priority Data

Mar. 5, 1987 [DE] Fed. Rep. of Germany ..... 3709669

[51] Int. Cl.[5] ..... A41B 9/14; A41D 1/06; A41D 1/14

[52] U.S. Cl. ..... 2/228; 2/227; 2/403; 2/406; 2/409; 66/177

[58] Field of Search ..... 2/409, 228, 227, 403, 2/406, 402; 66/177, 170

[56] References Cited

U.S. PATENT DOCUMENTS

| | | | |
|---|---|---|---|
| 459,866 | 9/1891 | Clewley | 66/170 |
| 1,139,342 | 5/1915 | Clewley | 66/170 |
| 1,185,933 | 6/1916 | Powell | 66/170 |
| 2,285,012 | 6/1942 | Burkey | 66/177 |
| 3,178,911 | 4/1965 | Faust | 66/177 |
| 3,656,323 | 4/1972 | Brown | 66/177 |
| 3,656,324 | 4/1972 | Jackson | 66/177 |
| 3,678,514 | 7/1972 | Safrit | 2/409 X |
| 3,685,319 | 8/1972 | Jackson | 66/177 X |
| 3,899,900 | 8/1975 | Jackson | 66/177 X |

FOREIGN PATENT DOCUMENTS

| | | | |
|---|---|---|---|
| 1925302 | 5/1969 | Fed. Rep. of Germany | 2/409 |
| 2038063 | 6/1970 | Fed. Rep. of Germany | 2/409 |
| 2134219 | 7/1971 | Fed. Rep. of Germany | 2/409 |
| 3004469 | 8/1984 | Fed. Rep. of Germany . | |
| 1143424 | 4/1957 | France | 66/195 |

*Primary Examiner*—Werner H. Schroeder
*Assistant Examiner*—Jeanette E. Chapman
*Attorney, Agent, or Firm*—Francis J. Bouda

[57] ABSTRACT

Reference is made to shorts or little skirt with an integral inner slip in which the shorts or little skirt on the one side, and the inner slip on the other side, are knitted together as one piece along their waistbands. A double layer knitting manufacturing process is described according to which the shorts or little skirt on the one side, and the inner slip on the other side, are knitted together in paralled rows along a common waistband running perpendicularly to their body axes, and pairs of shorts/skirts and inner slips are knitted continuously to subsequent pairs along common doubled seamed separating zones. Individual pairs of shorts/inner slips are then separated from the next pair and each pair is then subsequently folded into itself along a flexible transition point located in the waistband. According to the invention, the products are used to hold absorbant insert pads for use by incontinent adults.

6 Claims, 5 Drawing Sheets

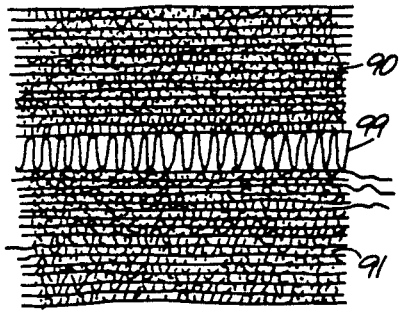
FIG. 5
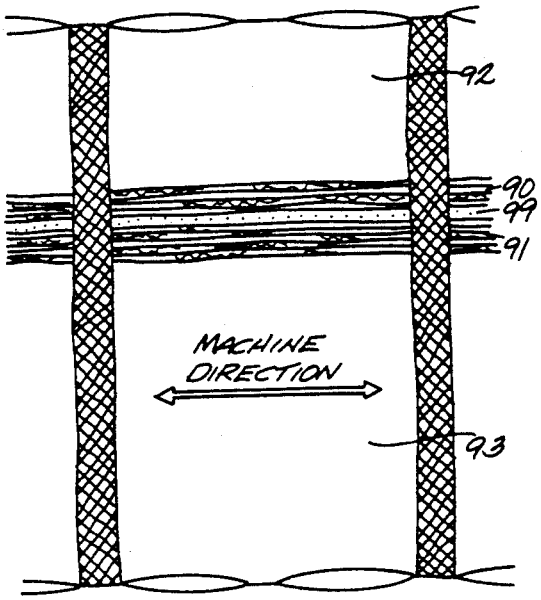
FIG. 4
FIG. 6
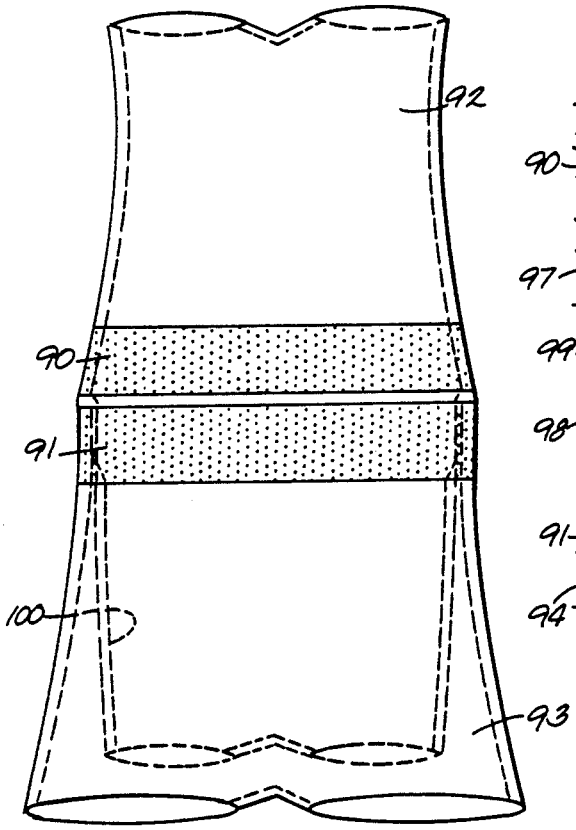
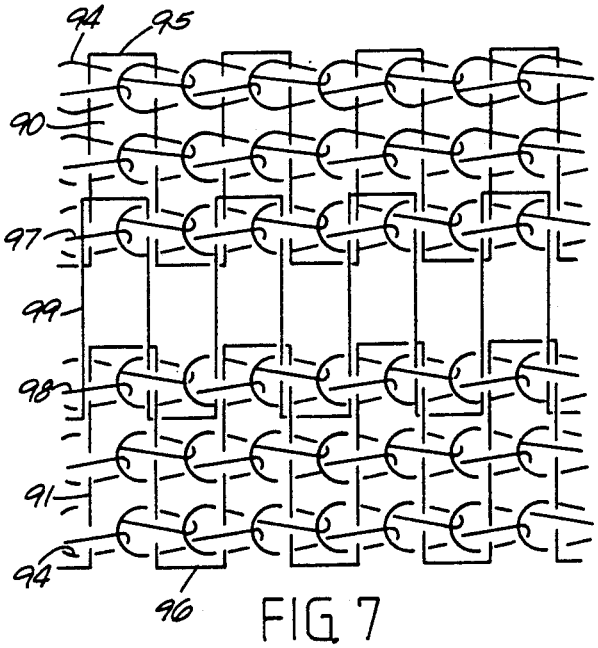
FIG. 7

SHORTS OR SKIRTS WITH INNER SLIP

The invention relates to a pair of outer shorts, or little skirt, with an inner slip which is joined firmly to the outer garment. The invention relates furthermore, to a new use of such garments.

The invention relates generally to warp knitted garments and the apparatus and method for making the same, and similar but different garments are shown and disclosed in the Jackson U.S. Pat. No. 3,899,900; the Jackson U.S. Pat. No. 3,656,324 and the Brown U.S. Pat. No. 3,656,323.

Pull-on underpants produced on a double-needle bar warp knitting machine of the type shown in the Jackson U.S. Pat. No. 3,656,324 according to a simple knitting method can be used, among other things, as holders of absorbent insert pads for incontinent adults. Pull-on underpants of the above-mentioned type not only lack stylish design, but are usually of such construction that the respective absorbent insert pad is clearly discernible when the underpants are worn without outer garments. Persons who depend on and use such aids and who are frequently found in hospitals, where they move around in the common areas, become aware, because of their inadequate underwear, in an embarrassing way of their physical shortcomings. The same embarrassment can also occur at home, since the above-mentioned absorbant pads are also used by active persons and convalescents.

The objective of the invention is to prevent embarrassing situations such as those described above from being seen and to provide means by which such situations can be avoided in a cost effective manner.

The solution is the use of warp-knitted shorts or little skirts which have inner slips as holders for absorbant insert pads worn by incontinent adults. The inner slip serves to hold the insert pads, whereas the shorts or the little skirt acts to conceal the incontinence aids, the very existence of which is embarrassing to the wearer.

Shorts with a sewn-in inner slip as sportswear, i.e. gym shorts or so-called running shorts, are generally known. The outer shorts of this type are customarily made of a tightly woven material and the inner slip usually consists of a knitted fabric. The ready-to-wear manufacturing of such shorts is very costly, especially because such shorts usually have fashionable appliques and/or pockets sewn on to the outer shorts. The use of such shorts for the aforementioned purpose is out of the question.

The solution, therefore, is found in shorts or a little skirt with an inner slip, in which the shorts or little skirt on the one side, and the inner slip on the other side, are knitted together as one piece along their waistbands. Thus, garments are made available for the above-mentioned incontinence uses which can be produced most cost-effectively as knitwear, especially because it avoids any sewing processes. Furthermore, it allows for a continuous manufacturing process in which the individual garments are produced purely by separating pairs from one another and by a subsequent folding process. The innovative products are particularly appropriate for the above-mentioned incontinence uses and can be produced most economically. By using raw materials of high quality and by producing tightly knitted fabrics, satisfactory results may also be expected in this realm. As a rule, without the ready-to-wear finishing touches, they would not meet the demands of fashion of sportswear.

Based on the innovative design, the waistbands of both parts of the final garment, i.e. shorts or little skirt on the one side, and inner slip on the other side, are joined together by particularly loosely knitted, short, flexible threads which are knitted perpendicularly to the respective waistbands, thus making it possible to turn the skirt over the slip without resistance or turn the inner slip into the outer shorts without difficulty because of the absence of a tightly knitted upper waistband border. Thus the side seams of the two parts of the garment face each other on the inside of the final garment, i.e. with respect to the inner slip, its side seams face outward, which increases wearing comfort; whereas the side seams of the shorts or little skirt are turned inward for a more fashionable and finished look. The necessary turning process requires that, with respect to the invented shorts, the inner slip be pulled through a pant leg of the outer shorts. This can be practically duplicated.

An elastic waistband is knitted in the particularly practical manner in the outer shorts or little skirt which holds up the shorts or skirt when worn. Of course, it may be preferred that after the parts of the innovative garments have been turned into each other to sew on a separate elastic waistband in a subsequent work process. e.g. if in a uniformly produced little skirt or shorts on the one side, and the slip on the other side—the inner slip is highly elastic (more elastic than the shorts)—various additional widths of the elastic waistband may be desired. Another reason for use a measure could be to meet fashion demands in the form of gatherings, pleats, etc.

It is very advantageous, particularly in view of the preferred use of the invented shorts or little skirt with inner slips, if they are anatomically shaped, i.e. if more material is used for the rear portion. The preferred methods of producing this detail on the invented garments as such shall be explained in the text below.

The invented process to produce the above-mentioned garments is characterized by the facts that the shorts or the little skirt on the one side, and the inner slip on the other side, are knitted together in parallel rows at a common waistband running perpendicularly to their body axes, and pairs of shorts/skirts and inner slips are knitted continuously to the next pair of shorts/-skirts and inner slips by common double-seamed separating zones. The products, which are produced in a continuous two-layer double-row are cut from one another at specific separating zones, and if necessary, are given final finishing touches. As a rule, they are made into the final product by simply turning them inside out. The double row, produced as a result of this invention, shows in the knitting direction and approximately in the center of the double row, the waistbands at the shared junction point of the two complete garments, i.e. it shows that the waistband is a narrow longitudinal band with a high degree of elasticity. At, or near, the outside edges of the double row of material, are the leg openings of the shorts (or the hem of the skirt) on one side, and the leg openings of the inner slips on the other side. The invention is also completely finished at the edges, i.e. no hemming is required either of the skirt of the leg openings or crotch of the shorts. The periodically double seams-and-separating zones are wide enough that, even in the event of slight inaccuracies, a separating cut perpendicular to the knitting direction can be made without difficulty.

According to an initial design of the process, the leg openings of the inner slips, which run parallel to the knitting direction, are formed by intermittent knitting in one continuous process the upper and lower layers of material together, thus making one of the layers the front of the inner slip and the other the back. With respect to the outer shorts of this innovation, this is the preferred production method.

In a further development of the above-described production method, the leg openings of the inner slips are knitted into one of the superimposed layers (upper or lower) of the product, as described in more detail in the German patent specifications. Thus, an inner slip with the familiar advantages and one that is shaped anatomically correctly, is produced.

In yet a further development suitable to produce the innovative little skirt with inner slip, the leg openings of the inner slip are knitted directly above and below one another, one into each upper and lower layer of the superimposed layers of the invention. The result of this production method is that in the finished product the front and back seams are located running perpendicular to the waistband in the middle of the body. This makes it possible to vary the shape of the inner slips, in particular to produce crotches of various widths.

In an advantageous further development of the above-mentioned process, the leg openings of the inner slip can be asymmetrically positioned with respect to the separating zones, which again results in an anatomically well-shaped inner slip with a greater amount of material in the rear portion.

The object of the invention will be explained below in more detail, based on preferred examples of construction, which are shown in the drawings.

FIG. 1*a* shows innovative little skirts and inner slips of three designs produced from double-row double-layer material.

FIG. 1*b* shows an innovative little skirt with inner slip after being separated from the continuous double row of material.

FIG. 2*a* shows innovative shorts with inner slip of two styles when produced from double-row double-layer material.

FIG. 2*b* shows a single pair of shorts with inner slip after having been separated from a continuous row of shorts and inner slips.

FIG. 4 is a schematic drawing of a portion of a web of garments illustrating particularly the waistband area of one of the garments.

FIG. 5 is an enlarged view of the waistband section shown within the circle in FIG. 4 illustrating particularly the two elastic waistband areas separated by a row of zigzag joining-weft threads.

FIG. 6 illustrates one of the garments of the present invention (after separation from the adjoining garments), with the inner-slip also shown in dotted lines as it will appear after being folded about the joining-weft threads and positioned within the outer portion of the brief.

FIG. 7 is an enlarged view of the stitch-loop arrangement of the waistband portion of the garment of the present invention illustrating particularly the joining-weft threads which connect the pillar-stitches and the weft-inlay threads.

Figure 1B:
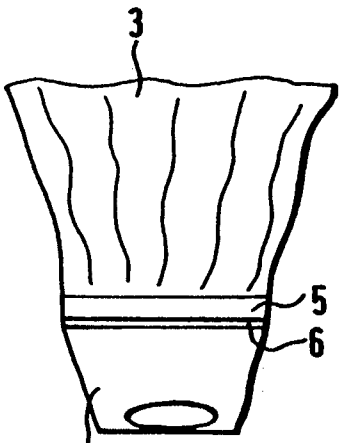
Figure 1A:
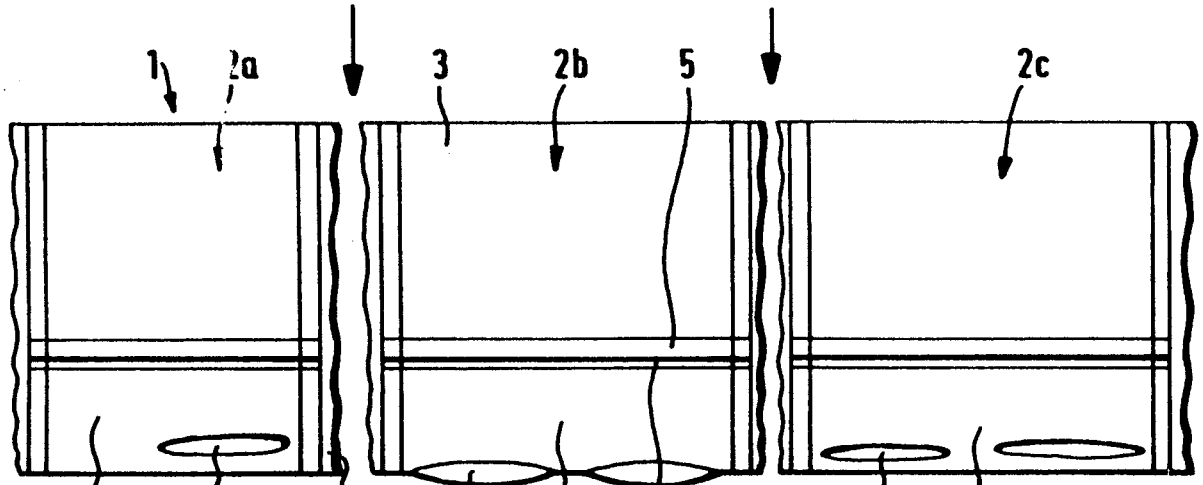

FIG. 1*a* shows a continuous needle bar warp knit fabric having double-layer material (1) which consists of individual innovative garments (2*a*, 2*b*, 2*c*) of different designs which always include a skirt (3) and an inner slip (4*a*, 4*b*, 4*c*). A waistband (5) is attached to each skirt. A flexible section (6) serving as transition to the inner slip is joined to the waistband. The garments (2*a*, 2*b*, 2*c*) are in the process of being finished, and are shown, after having been cut from one another at the locations indicated by the arrows. These locations are the areas of the double seams and separating zones (7). With respect to inner slip (4*a*), two superimposed leg openings (8*a*), which are located asymmetrically to the separating zones (7), are knitted into the upper and lower layers of the invention. On the inner slip (4*b*), the leg openings (8*b*), situated one following the other in the knitting direction, are located at the junction of the outside edges of the upper and lower layers, whereas in the inner slip (4*c*), the leg openings (8*c*) are located solely in either the upper or lower layer, i.e. asymmetrical in the slips, lying one following the other in the knitting direction, thus resulting in more anatomically shaped inner slip.

FIG. 1*b* shows the innovative skirt with inner slip based on model (4*a*), as diagramed in FIG. 1*a*. On account of the varying ratios of elastic thread, the waistband (5) as well as the inner slip (4) have contracted whereas the little skirt (3) made of less or non-elastic material is gathered into pleats especially at the waistband. The finished product is produced by pulling the skirt down over the inner slip, thus producing a folded edge at the transition zone (6).

Figure 2B:
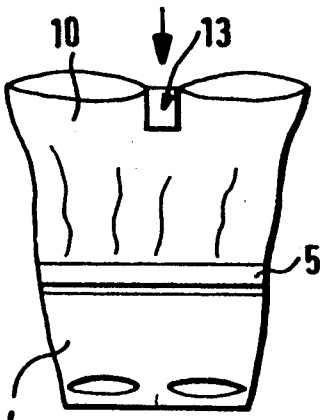
Figure 2A:
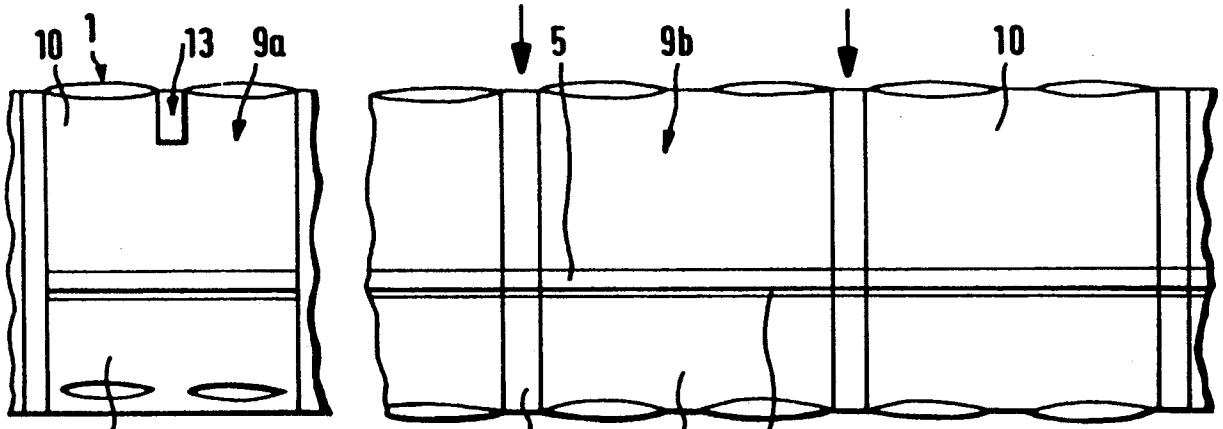

FIG. 2*a* shows a continuous needle bar warp knit fabric having a double-layer of material (1) from which two types of finished products (9*a*) can be recognized, which consist of the outer shorts (10) and inner slips (4*a*) knitted to one another. The shorts in the model (9*a*) show a knitted gusset (13) which, after being slit, produces the beginning of legs. This distinguishing feature has been omitted in the two shorts (9*b* and 10) which are still joined to one another. Furthermore, an individual inner slip (4*c*) attached to shorts (9*a*) is shown, as well as two inner slips (4*a* and 4*b*) and outer shorts (9*b* and 10) pairs joined together with as yet uncut separating zones (7). The shorts show a continuous elastic waistband (5) to which is joined on the inner slip (4) side a continuous connecting zone (6) which is made of a flexible knit.

FIG. 2*b* shows a garment of design 9*a* in FIG. 2*a* after it has been separated from FIG. 2*a*, in relaxed form due to the elastic elements of the waistband (5) and inner slip (4). The shorts (10), made principally of elastic material only in the waistband, are therefore gathered. The crotch (13) may be slit at the point marked by an arrow. In order that the seams, which are not shown in detail, but which are on the outside, should face inside when the product is finished, one of the two pant-like parts has to be pulled through a leg opening of the other part.

Figure 3:
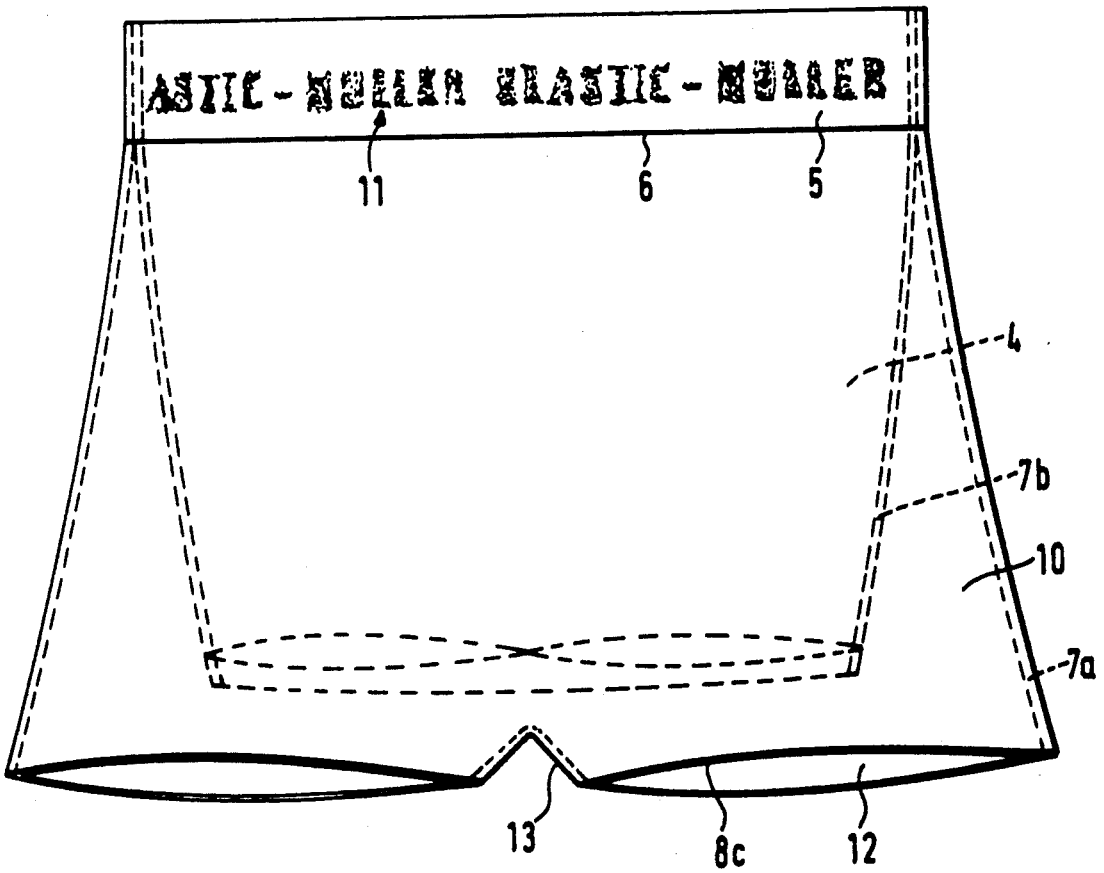
FIG. 3 shows innovative shorts with inner slip as an individual finished garment after being separated and turned.

FIG. 3 shows the result of the aforementioned turning procedure in which the shorts (10) are shown by unbroken lines, and the inner slip (4), inside said shorts, is indicated by the thin broken lines. The shorts show an elastic waistband (5) which can be produced with a pattern or, as shown here, with an inscription knitted into it. The flexible transition and folding zone (6), which is immediately followed by the top of the inner slip (4), is located at the upper edge of the elastic waistband. The now internally located half of the separating zones and seams (7*a*) can be recognized on the shorts. The other half of the separating zones and seams (7*b*) are seen located externally on the inner slip (4). The leg openings (12) of the shorts are located along the edges, whereas the leg openings (8*c*) of the inner slip are located in any of the previously mentioned double warp knitted positions desired to produce an anatomically-shaped inner slip.

By referring to FIG. 4–7 inclusive, one notes that the waistband portions 90 and 91 are more tightly knitted than the body portion 92 (of the inner brief side) and the body portion 93 (of the boxer short or skirt side).

The waistbands 90 and 91 consist of elastic pillar-stitch threads 94 which extend in the machine direction as the garments are being made.

The elastic waistband portions also include weft-inlay threads 95 (in waistband portion 90) and 96 (in waistband portion 91).

At least one row of the pillar-stitches (97 in waistband portion 90 and 98 in waistband portion 91) have looped around them a row of zig-zag joining-weft threads 99.

The frequency of the joining weft-threads 99 is short (the same as the weft-inlay threads 95 and 96, but between the waistband portions 90 and 91, and particularly between the rows 97 and 98 of the pillar-stitch threads, a folding-portion is created because several lines of the elastic pillar-stitch threads are not present, and the zig-zag joining weft-threads 99 in the fold-portion have a longer travel in the cross-machine direction. Thus they may only seem to be visually shorter, but that is an optical illusion created because the rows of pillar-stitches in the fold-portion have been eliminated.

This construction is clearly illustrated in the point diagram (or stitch loop illustration) of FIG. 7.

FIG. 7 clearly illustrated that by "short threads", is meant only the visual appearance of the garment construction in the cross-machine direction. The loops merely appear like breaks in the otherwise tightly knitted waistband construction 90 and 91, and thus by the term "loosely", Applicant means to describe large, open knit loops, and by "tightly" is meant small, close-knit loops.

Because the garments are knitted as a continuous tube consisting of the two body portions and the waistband portion, separated by a folding zone, the plural layering effect is not evident until the garment is worn (wherein the second body portion 92 is folded into and within the first body portion 93 along the waistband portion). This is illustrated in FIG. 3 and also particularly in the dotted line portion 100 in FIG. 6.

The present invention relates only to the stitch formation in the waistband of a garment. The total garment has been described as being a pair of shorts or a skirt, which is provided with an inner slip.

Figure 8:
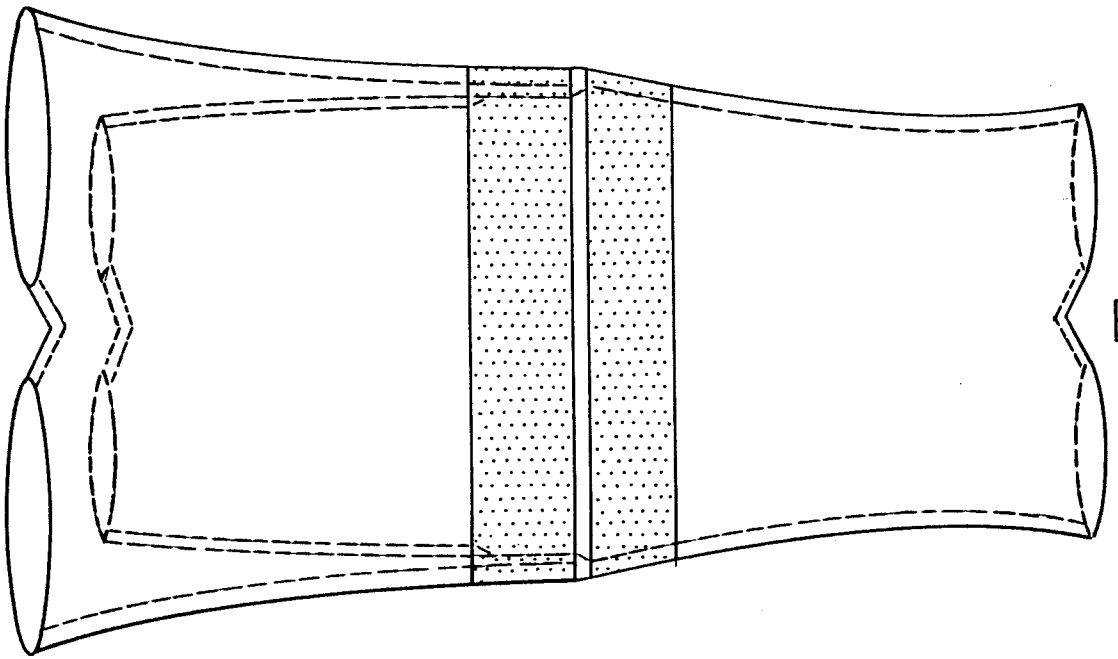
FIG. 8 is a view similar to FIG. 6 illustrating more clearly the waistband configuration.

The garment (as shown in FIG. 8) is not, per se, the subject of this invention, but it is the waistband stitching formation which enables the tubular material to be folded along a mid-line, easily and without bunching, so that one portion of the tubular garment becomes the "inner slip" disposed within the skirt or the shorts, as the case may be.

Figure 9:
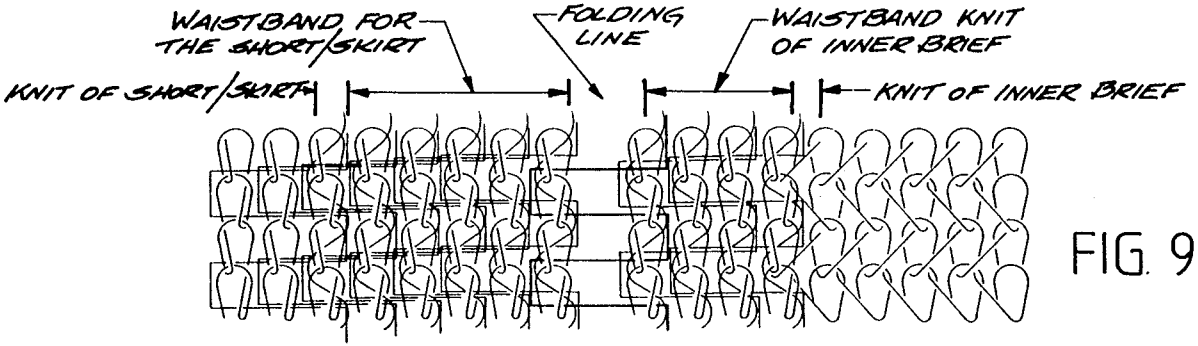
FIG. 9 is a view similar to FIG. 7 but illustrating more clearly the variety of stitch configurations in the waistband area.
Figure 10:
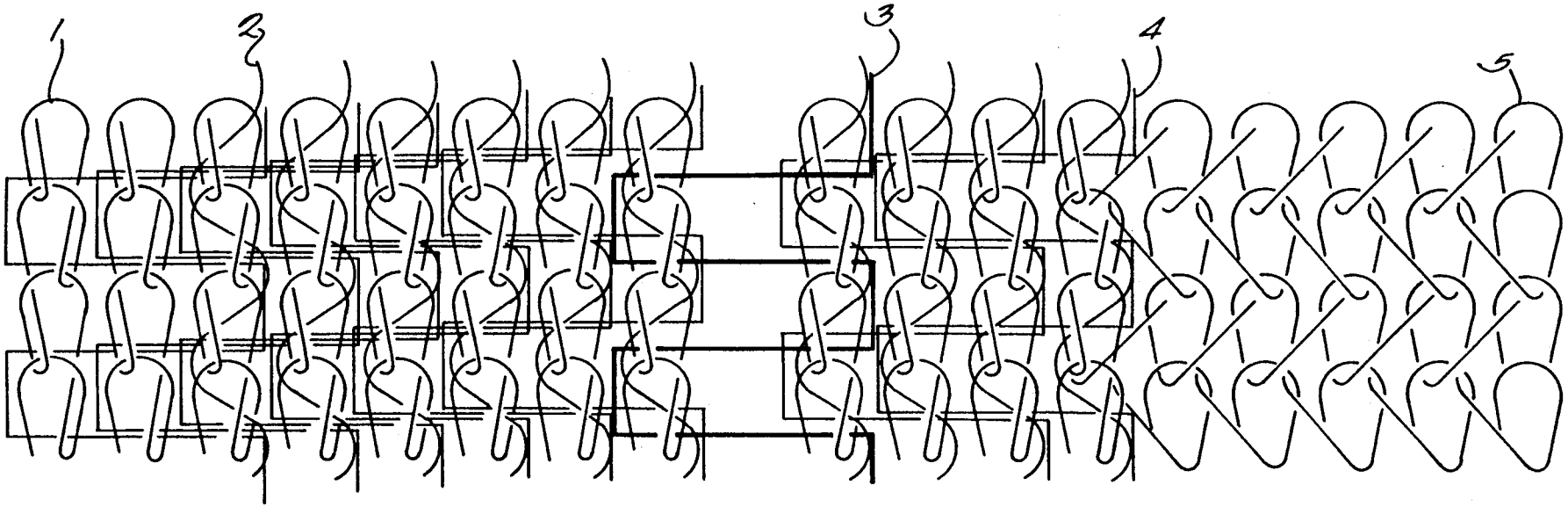
FIG. 10 is a greatly enlarged view similar to FIG. 9 but illustrating more clearly a stitch-loop diagram of the formation of the waistband.

The stitch-loop diagram, which is shown clearly in FIGS. 9 and 10, is that portion of the waistband of the garment shown in FIG. 8.

The elements of the waistband portion are clearly shown in the test accompanying FIG. 9, and which include:

1. The knitted portion of the short/skirt,
2. The waistband for the short/skirt,
3. "Folding line",
4. The waistband knit of the inner slip or brief,
5. The knitted portion of the inner slip or brief.

The dotted line portion of FIG. 8 shows how the inner brief or slip can be folded about the "folding line" to be disposed within the inner portion of the short/-skirt.

FIG. 10 is a greatly enlarged stitch point diagram wherein:

1. Numeral 1 indicates the pillar stitch,
2. Numeral 2 indicates the "LYCRA" (DuPont trademark) weft thread,
3. Numeral 3 indicates the thread which joins the two waistbands along the "folding line" and is sometimes called the "folding weft insertion thread".
4. Numeral 4 indicates the weft thread.
5. Numeral 5 indicates the tricot stitch knitting the main body of the short/skirt.

As can be clearly seen from FIG. 10, the technical stitch point drawings show specifically how the various threads are knitted to create a boxer short or skirt material, as well as the waistband portion of the boxer short or skirt, the knitted portion along which the waistbands are folded, the inner slip waistband portion, as well as the inner slip itself.

The stitch point diagram shows how the weft insertion thread is often described in the trade as being "loosely knitted" or "openly knitted".

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. Shorts including a first body portion to be worn as an outer member and a second body portion to be worn as an inner member, and a waistband portion connecting said first and second portions, said first body portion, second body portion, and waistband portion comprising a one-piece, warp knitted tube with the waistband portion disposed between and connecting said first and second body portions, said second body portion having a front portion and a rear portion and adapted to be folded inwardly into the first body portion along the waistband portion whereby to provide a liner within said first body portion when worn by the wearer.

2. The shorts of claim 1 wherein said first and second body portions are joined together with flexible, loosely-knitted threads.

3. The shorts of claim 1 wherein the waistband portion consists of short, flexible, loosely-knitted threads.

4. The shorts of claim 1 wherein the waistband portion is elastic.

5. The shorts of claim 1 wherein the first body portion and the second body portion are densely knitted with non-elastic thread.

6. The shorts of claim 1 wherein the waistband portion has been knitted predominantly with elastic thread.

* * * * *